US005737883A

United States Patent [19]

Rose

[11] Patent Number: 5,737,883

[45] Date of Patent: Apr. 14, 1998

[54] ANCHOR FOR A CANOPY FRAMEWORK AND METHOD OF USE

[76] Inventor: Barbara Rose, 795 Sun Joy Dr., Hemet, Calif. 92543

[21] Appl. No.: 796,967

[22] Filed: Feb. 7, 1997

[51] Int. Cl.[6] ..... E02D 27/00

[52] U.S. Cl. ..... 52/169.9; 52/158; 52/165; 52/166; 135/161; 135/120.1; 135/114; 248/345

[58] Field of Search ..... 52/169.9, 158, 52/165, 166; 135/118, 161, 120.1, 114; 248/124.2, 149, 154, 182.1, 176.3, 188.4, 345, 910

[56] References Cited

U.S. PATENT DOCUMENTS

| | | | |
|---|---|---|---|
| 165,557 | 7/1875 | Geer | 52/165 |
| 2,521,768 | 9/1950 | Adams | 135/118 X |
| 3,474,802 | 10/1969 | Loring | 135/125 |
| 4,029,117 | 6/1977 | Rain | 135/118 X |
| 5,490,532 | 2/1996 | Mallookis et al. | 135/114 X |

*Primary Examiner*—Carl D. Friedman
*Assistant Examiner*—W. Glenn Edwards
*Attorney, Agent, or Firm*—Ted Masters

[57] ABSTRACT

An anchor (20) which is attachable to the leg (500) of a canopy (502) framework includes a bar (22) having a foot (30), a weight (32), and at least one attaching means for attaching the anchor (20) to the leg (500). The anchor (20) is useful in circumstances where the wind could lift, displace, or overturn the canopy (502) and associated framework.

17 Claims, 6 Drawing Sheets

Fig. 7
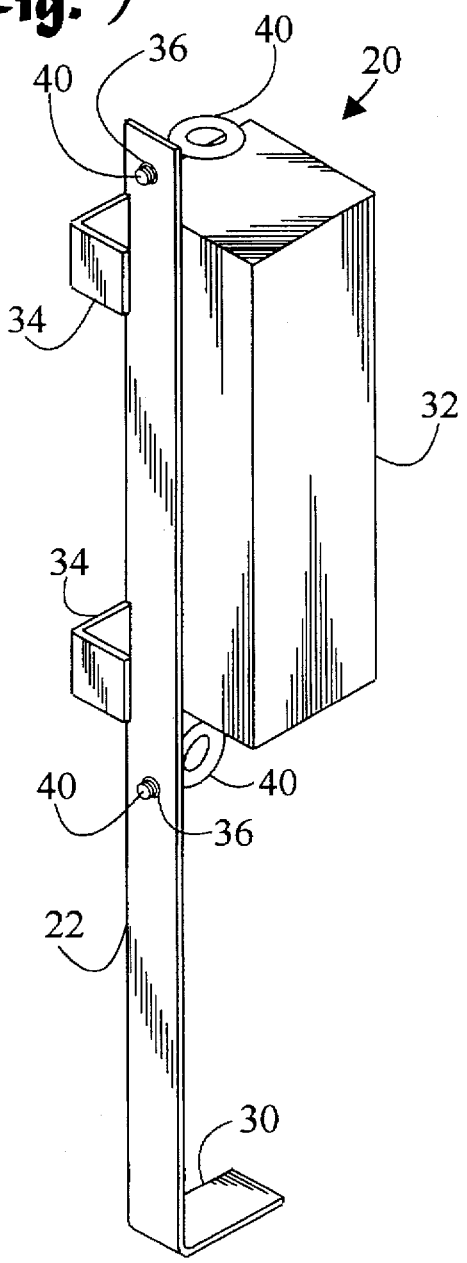
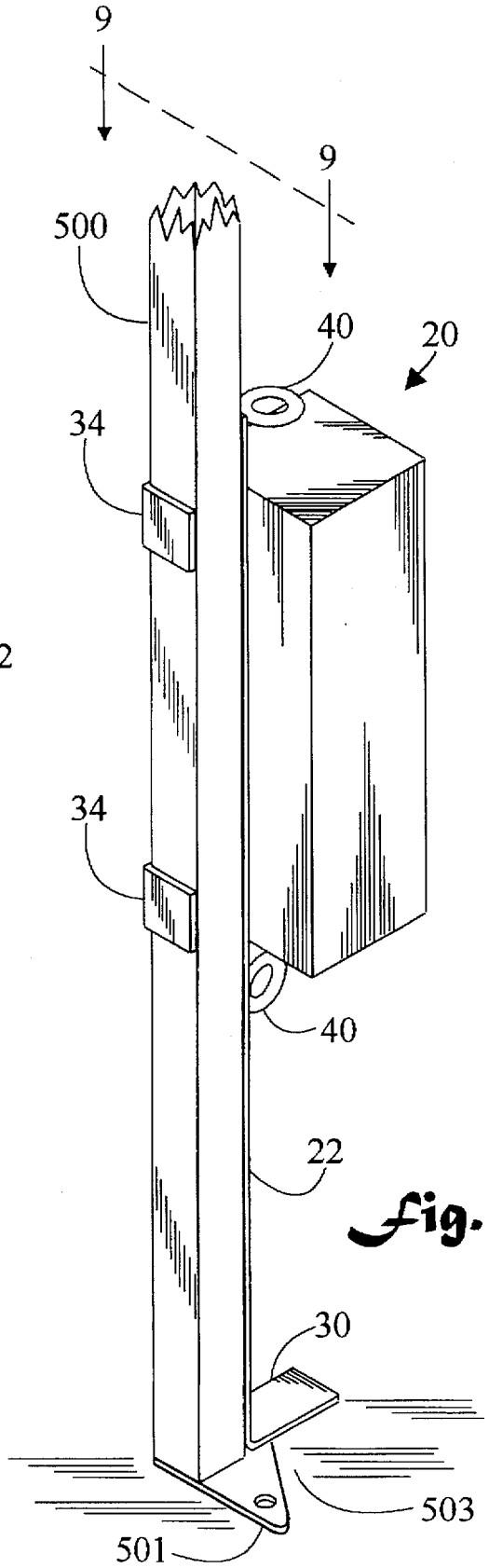
Fig. 8

Fig. 12
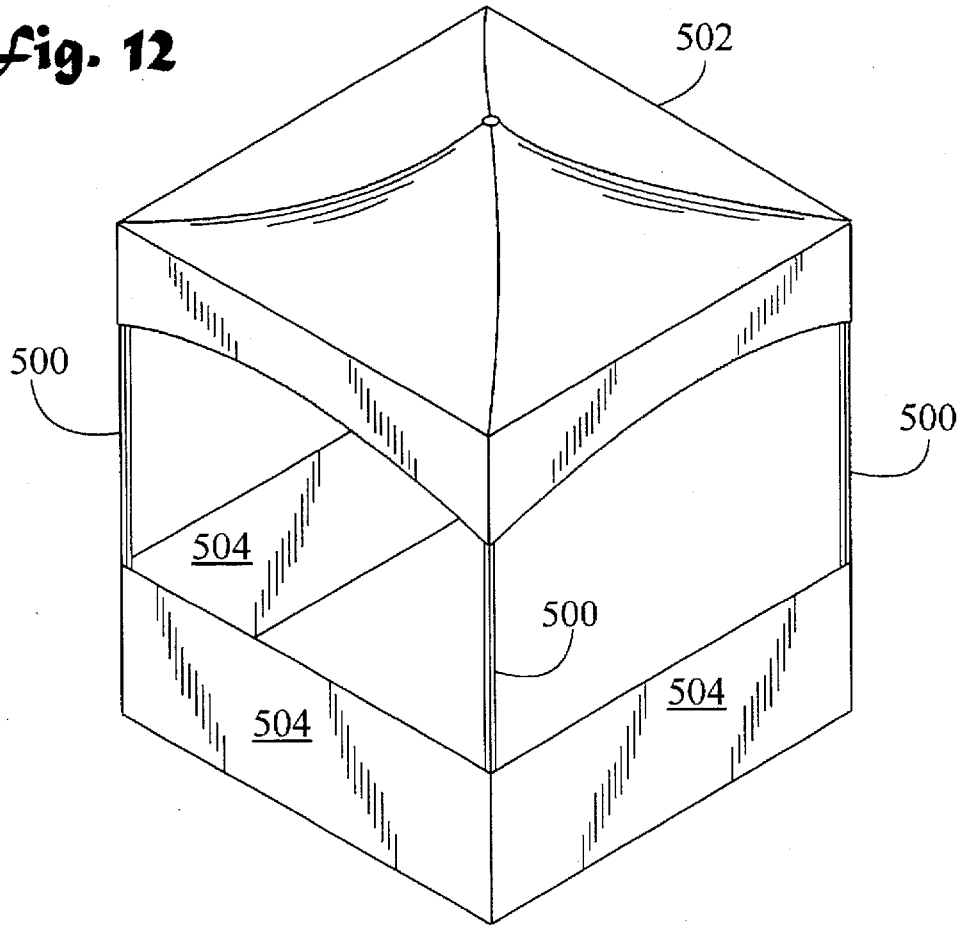
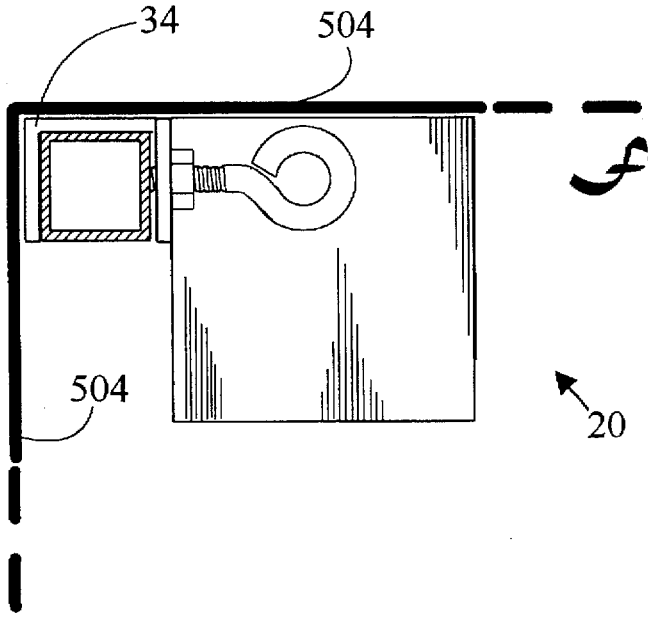
Fig. 13

ANCHOR FOR A CANOPY FRAMEWORK AND METHOD OF USE

TECHNICAL FIELD

The present invention pertains to canopies which have a supporting framework, and in particular to an anchor which attaches to the legs of the framework to prevent the canopy and framework from being displaced or blown over by high winds.

BACKGROUND ART

Canopies and their supporting frameworks are well known in the art. These devices typically consist of a covering or roof (canopy) which is attached to an underlying framework. The framework includes an overhead truss structure for supporting the canopy, and legs upon which the framework rests. Such a device is disclosed in U.S. Pat. No. 5,244,001.

Canopies and their frameworks have a multitude of applications, and are particularly useful in outdoor settings where protection from sun, wind, and rain are desired. Specific uses can range from outdoor restaurants and sales booths, to beach shelters and wedding covers. In certain applications, it is desirable to add sidewalls, rail skirts, corner curtains, or screen enclosures, to the basic canopy and framework structure. International E-Z UP, Inc. of 1601 Iowa Avenue, Riverside, Calif. 92507 manufactures and sells a broad spectrum of canopies, frameworks, and accessory products.

One drawback of canopies and their frameworks is the wind. High winds can lift, displace, or even blow over the canopy/framework structure, resulting in possible property damage and physical injury. To reduce this occurrence, and where the ground surface permits, stakes can be driven and attached to the framework legs. In those instances where stakes cannot be used, such as on concrete or asphalt surfaces, weight bags can be attached to the framework legs. International E-Z UP, Inc. sells 20 lb. weight bags which are filled with sand. The weight bags are shaped like a baseball base, are attached by a snap pin to the bottom of the framework leg, and rest on the ground. These weight bags, while useful in reducing the undesirable effects of the wind, have certain disadvantages. By resting on the ground the weight bags take up floor or ground space which could otherwise be occupied by useful items such as tables, merchandise, boxes, chairs, etc.. Additionally, the ground location of the weight bag (or stake) creates a potential tripping hazard. Further, by presenting an obstacle, the weight bag can interfere with the installation of sidewalls and rail skirts to the canopy framework.

DISCLOSURE OF INVENTION

The present invention is directed to an anchor for a canopy framework which overcomes the disadvantages attendant to stakes and weight bags. The anchor is quickly and easily attached (clamped) to each of the canopy framework legs by means of a holder and cooperating eyebolt. The anchor includes a weight which is elevated off of the ground thereby not occupying floor or ground space which could be better employed. The holder is closely contoured to the framework leg so as not to impede the installation of sidewalls, rail skirts, and the like. The anchor further includes a supporting bar having a foot which rests on the ground, on in some instances a leg bottom flange, thereby removing any downward force upon the framework leg. The foot additionally impedes the anchor and leg from digging into a soft ground surface such as dirt or hot asphalt, and further can serve as a convenient handle for carrying the anchor.

In accordance with a preferred embodiment of the invention, an anchor attachable to a leg of a canopy framework includes a bar having a first top end, an opposite second bottom end, and a mid portion therebetween. The second end has a foot which extends outward from the bar at a substantially right angle. At least one attaching means for attaching the bar to the leg is provided. A weight is connected to the bar.

In accordance with an important feature of the invention, a first attaching means is located near the first top end of the bar, and a second attaching means is located near the mid portion of the bar.

In accordance with an important aspect of the invention, the weight is located substantially between the first attaching means and the second attaching means.

In accordance with another important feature of the invention, when the anchor is installed on the leg of the canopy framework, both attaching means are located at a vertical distance from the ground which obviates stooping or kneeling by the user.

In accordance with an important aspect of the invention, the second attaching means is located at least substantially six inches from the second end.

In accordance with another important aspect of the invention, the first and second attaching means further include (1) a right angle-shaped holder sized to receive the leg, (2) a thruhole in the bar, (3) a threaded socket connected to the bar and centered over the thruhole, and (4) a bolt threadably engaging the threaded socket, so that when the bolt is turned the bolt passes through the thruhole and urges the leg into pressurized contact with the holder, thereby clamping the anchor to the leg.

In accordance with another important feature of the invention, the holder is closely contoured to the leg so that sidewalls and skirts may be installed without incumbrance.

In accordance with a preferred embodiment of the invention, the bar does not run the entire length of the anchor, but rather is only connected to the bottom of the weight.

Other features and advantages of the present invention will become apparent from the following detailed description, taken in conjunction with the accompanying drawings, which illustrate, by way of example, the principles of the invention.

BRIEF DESCRIPTION OF DRAWINGS

FIG. 7 is a perspective view of the anchor;

FIG. 8 is a perspective view of the anchor attached to the square tube leg of the canopy framework;

FIG. 12 is a reduced perspective view of FIG. 11 with a rail skirt installed;

FIG. 13 is the view of FIG. 9 showing the anchor in relation to the rail skirt; and, FIG. 14 is a perspective view of a second embodiment.

MODES FOR CARRYING OUT THE INVENTION

Figure 1:
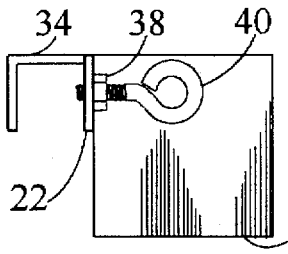
FIG. 1 is a top plan view of the anchor in accordance with the present invention.

Referring initially to FIGS. 1–3 and 7, there are illustrated top plan, side elevation, opposite side elevation, and perspective views respectively of an anchor in accordance with the present invention, generally designated 20. Anchor 20 may be selectively attached and removed from the leg 500 of a canopy 502 framework (refer to FIG. 11). Anchor 20 includes bar 22 which has a first end 24, an opposite second end 26, and a mid portion 28 therebetween. Second end 26 has a foot 30 which extends outward from bar 22 at a substantially right angle. Weight 32 is connected to bar 22. In the embodiment shown, weight 32 is located substantially between first and second attaching means (see discussion immediately below).

At least one attaching means for attaching bar 22 (and therefore weight 32) to leg 500 is provided. In the preferred embodiment shown, a first attaching means is located near first end 24, and a second attaching means is located near mid portion 28. In the embodiment shown, first and second attaching means each include a right angle-shaped holder 34 sized to receive leg 500. In the embodiment shown, holder 34 is connected to and protrudes from bar 22. Holder 34 could also be connected to weight 32, or to both weight 32 and bar 22. Bar 22 has a thruhole 36 (refer to FIG. 4). A threaded socket 38 is connected to bar 22 and centered over thruhole 36. In a preferred embodiment, threaded socket 38 is a common nut which is welded to bar 22. A bolt (eyebolt) 40 threadably engages threaded socket 38 so that when eyebolt 40 is turned it passed through thruhole 36 and urges leg 500 into pressurized contact with holder 34 and thereby clamps anchor 20 to leg 500. The design of the attaching means can accommodate legs 500 having either a square or circular cross sectional shape. It is further noted that holders 34 allow for the easy and quick attachment and removal of anchor 20 about leg 500.

If may readily be appreciated that other attaching means could be utilized to attach anchor 20 to leg 500; for example, pins which could be inserted in a hole in leg 500, belts and buckles, straps, Velcro™ fasteners, mechanical latches, tape, rope, etc.

Additionally, the attaching means are located a convenient vertical distance above the ground. In this fashion, both attaching means can be engaged by a user by simply bending over without the necessity of stooping or kneeling. Placing the second attaching means a distance of substantially six inches or more from second end 26 has been found useful for this purpose.

It is further noted, that by placing weight 32 substantially above second attaching means, weight 32 is elevated and therefore does not occupy floor or ground space.

Anchor 20 can be fabricated from a variety of materials. In a preferred embodiment bar 22, weight 32, and holder 34 are made from iron or steel, wherein weight 32 and holders 34 are attached to bar 22 by welding. The specific dimensions of anchor 20, and particularly holder 34, can be adjusted to accommodate any size framework leg 500. Similarly, the weight of weight 32 can be selected to best fit the anticipated wind conditions. A weight of 25 lbs. has been found useful.

Figure 2:
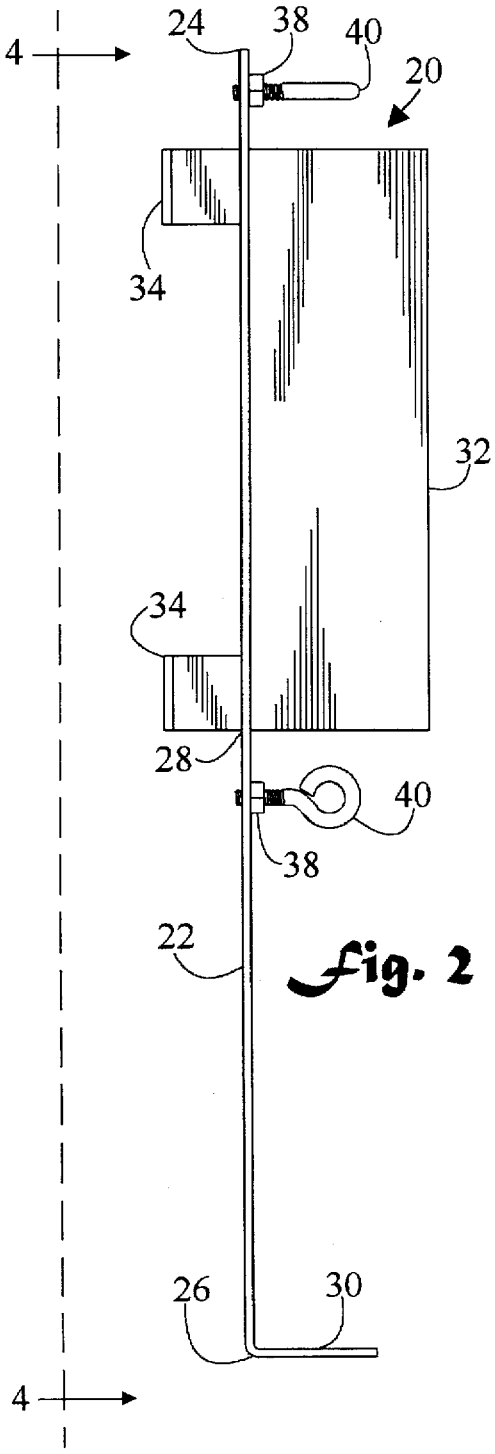
FIG. 2 is a side elevation view of the anchor.
Figure 4:
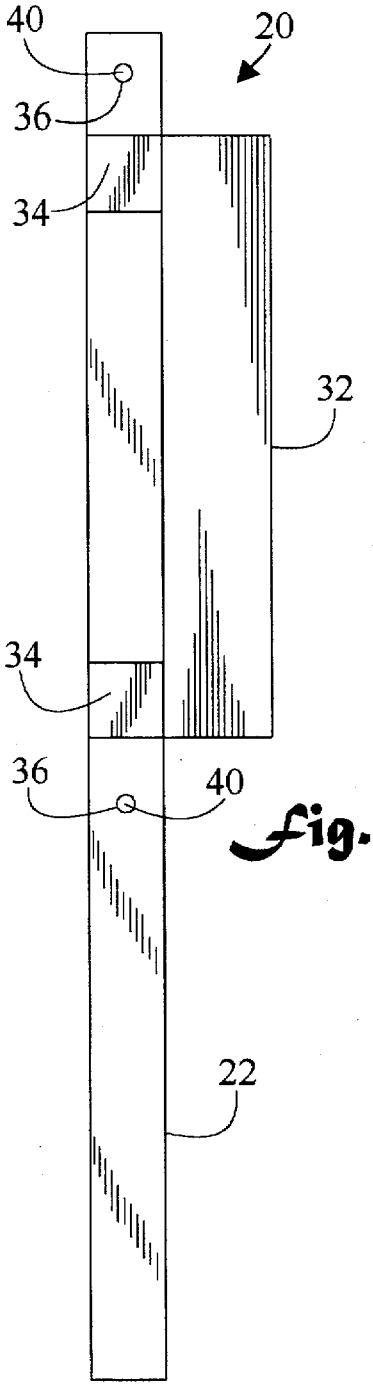
FIG. 4 is a front elevation view of the anchor along the line 4—4 of FIG. 2.

FIG. 4 is a front elevation view of anchor 20 along the line 4—4 of FIG. 2.

Figure 3:
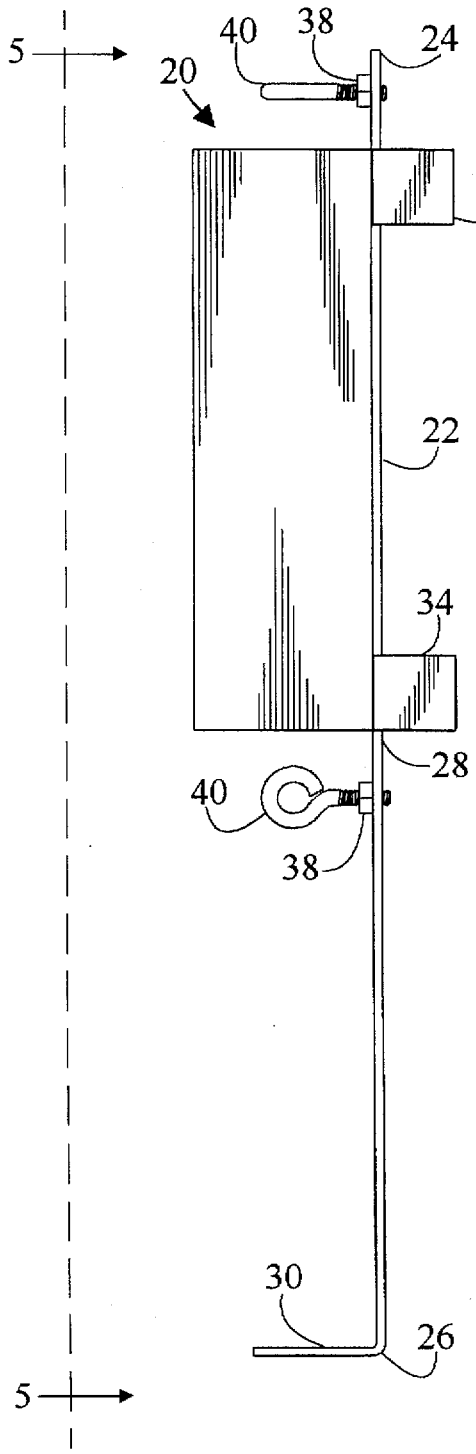
FIG. 3 is an opposite side elevation view of the anchor.
Figure 5:
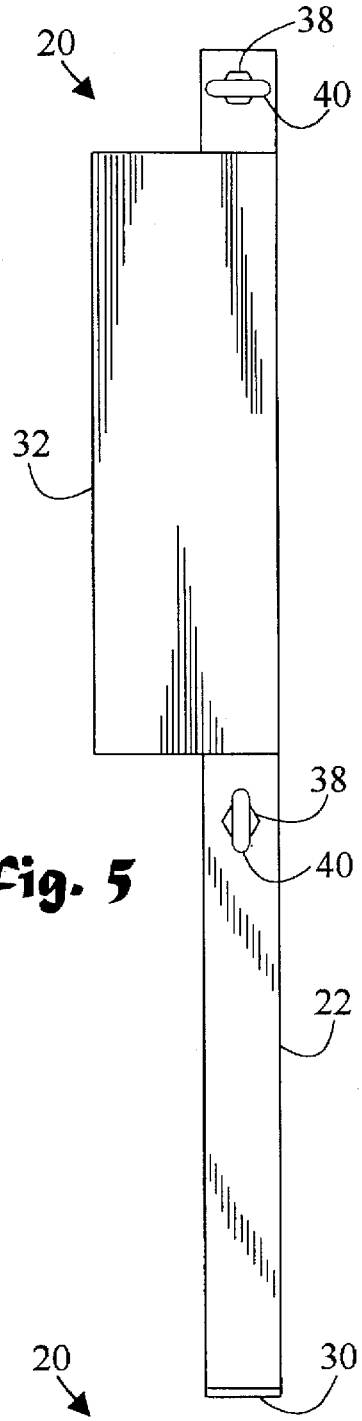
FIG. 5 is a rear elevation view of the anchor along the line 5—5 of FIG. 3.

FIG. 5 is a rear elevation view of anchor 20 along the line 5—5 of FIG. 3.

Figure 6:
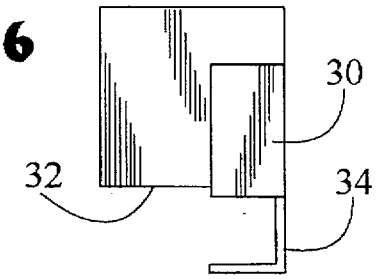
FIG. 6 is a bottom plan view of the anchor.

FIG. 6 is a bottom plan view of anchor 20.

FIG. 7 is a perspective view of anchor 20.

FIG. 8 is a perspective view of anchor 20 attached to the square tube leg 500 of canopy 502 framework. In the embodiment shown, leg 500 has a bottom flange 501, upon which leg 500 rests. In this embodiment foot 30 rests upon bottom flange 501, which in turn rests upon the ground 503. For legs 500 which do not have bottom flange 501, foot 30 would rest directly on the ground 503. In either case, foot 30 bears all of the weight of anchor 20, and no steady state downward force is exerted on leg 500 by anchor 20. Only when the wind exerts an upward force on canopy 502 and therefore legs 500, does anchor 20 exert a corresponding downward force on leg 500.

Figure 9:
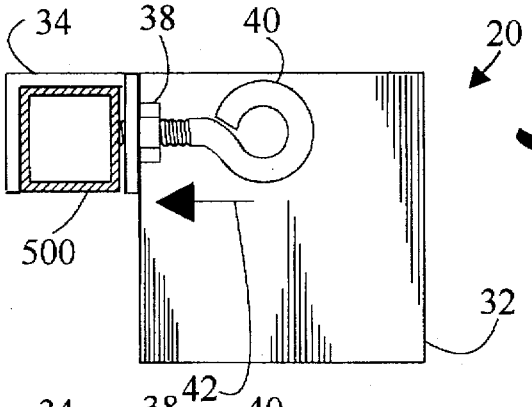
FIG. 9 is an enlarged view along the line 9—9 of FIG. 8.

FIG. 9 is an enlarged view along the line 9—9 of FIG. 8. Square tube leg 500 is received by holder 34 and fixedly held in position within holder 34 through the urging action of eyebolt 40 in direction 42.

Figure 10:
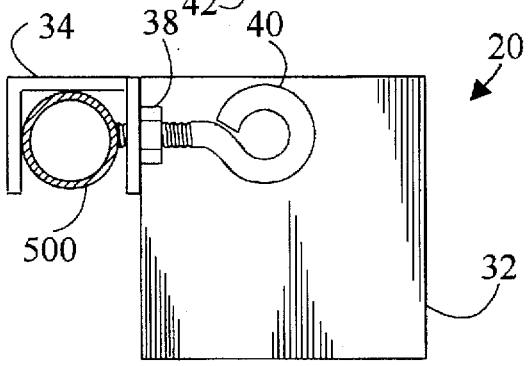
FIG. 10 is the view of FIG. 9 showing a round tube leg.

FIG. 10 is the view of FIG. 9 showing a round tube leg 500.

Figure 11:
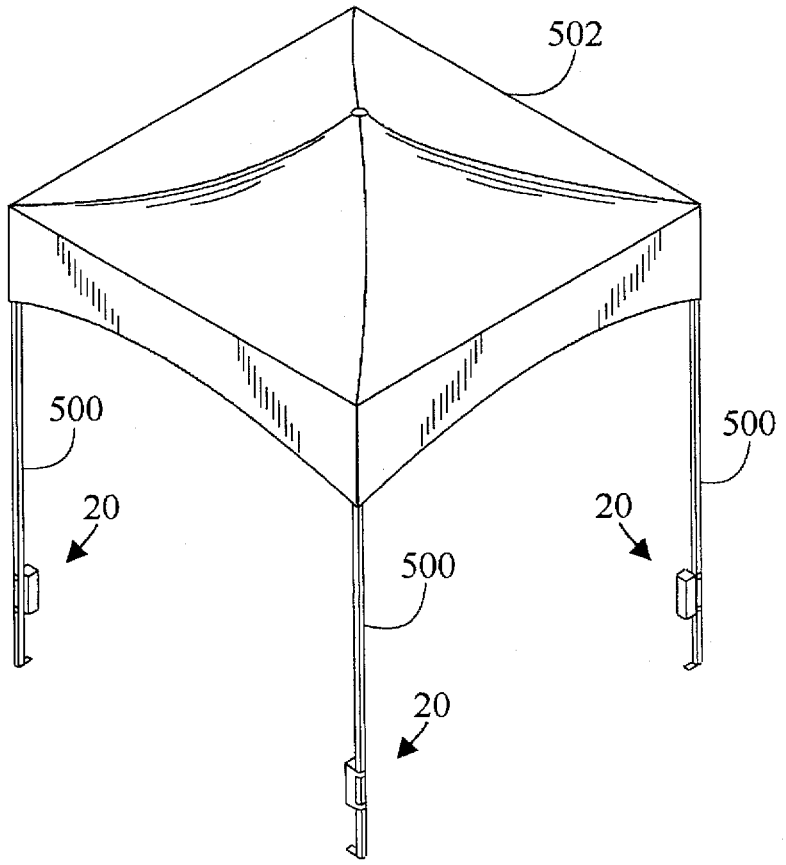
FIG. 11 is a reduced perspective view of the anchor installed on the legs of a canopy framework.

FIG. 11 is a reduced perspective view of anchor 20 installed on the legs 500 of a canopy 502 framework. It is noted that the overhead trussed portion of the framework is hidden by canopy 502.

FIG. 12 is the reduced perspective view of FIG. 11 with a rail skirt 504 installed, and FIG. 13 is a top plan view showing anchor 20 in relation to rail skirt 504. The rail skirt 504 is attached around the perimeter of legs 500 by means of zippers or Velcro™ straps. Because the attaching means, and specifically holder 34, is closely contoured to leg 500, there is no interference encountered when installing skirt 504. There would similarly be no interference encountered when installing a canopy side, screen, or the like.

Figure 14:
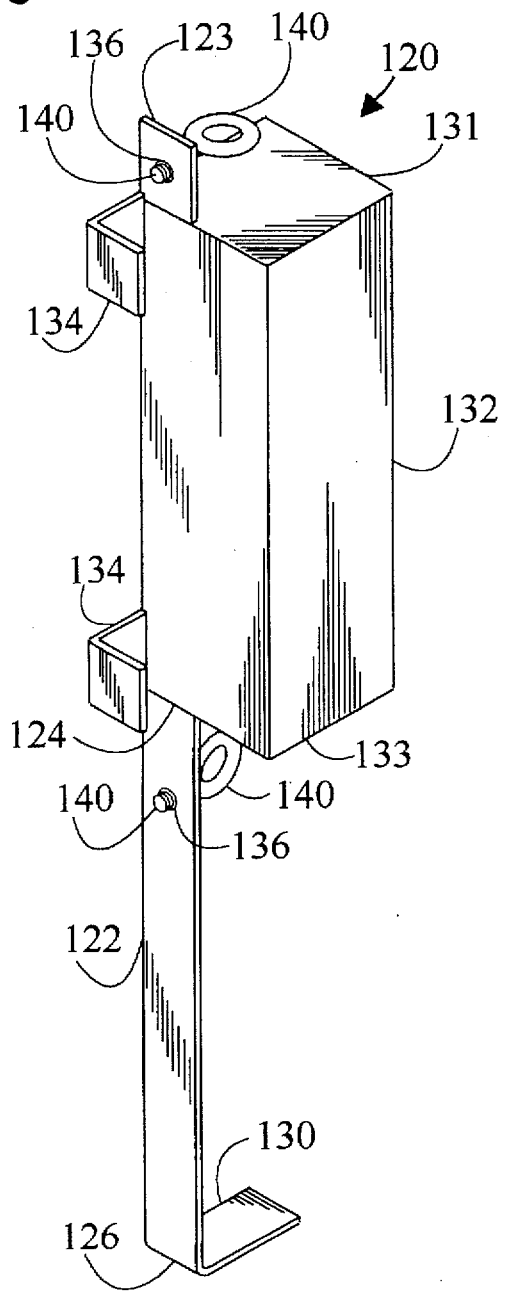

FIG. 14 is a perspective view of a second embodiment, generally designated as 120. Anchor 120 is almost identical to anchor 20, only differing in the length of bar 122. In anchor 20, bar 22 runs the entire length of the anchor. In anchor 120, bar 122 does not run the entire length of anchor 120, but is rather only connected to the bottom of weight 132. Therefore, the attaching means directly connect weight 132 to leg 500 without an intervening bar.

Anchor 120 includes bar 122 which has a first end 124 and an opposite second end 126. Second end 126 has a foot 130 which extends outward from bar 122 at a substantially right angle. Weight 132 has a first end 131 and an opposite second end 133. Second end 133 of weight 132 is connected to first end 124 of bar 122.

At least one attaching means for attaching weight 132 to leg 500 is provided. In the preferred embodiment shown, a first attaching means is located near first end 131 of weight 132, and a second attaching means is located near second end 133 of weight 132. A supplemental bar 123 is connected to first end 131 of weight 132. In the embodiment shown, first and second attaching means each include a right angle-shaped holder 134 sized to receive leg 500. In the embodiment shown, holder 134 is connected to and protrudes from weight 132. Bars 122 and 123 have thruholes 136. A threaded socket 138 is connected to bars 122 and 123 and is centered over thruhole 136. In a preferred embodiment, threaded socket 138 is a common nut which is welded to bars 122 and 123. An eyebolt 140 threadably engages threaded socket 138 so that when eyebolt 140 is turned it passed through thruhole 136 and urges leg 500 into pressurized contact with holder 134 and thereby clamps anchor 120 to leg 500. The design of the attaching means can accommodate legs 500 having either a square or circular cross sectional shape. It is further noted that holders 134 allow for the easy and quick attachment and removal of anchor 120 about leg 500.

Anchor 20 is easily attached to leg 500 by transporting the anchor 20 to the proximity of a leg 500. In so doing, anchor 20 can be conveniently carried by foot 30 which serves as a handle. Anchor 20 is oriented so that foot 30 is pointed down. Anchor 20 is then positioned so that the first (top) and second (bottom) attaching means receive leg 500. That is, holders 34 are placed around leg 500. The attaching means are then engaged so that anchor 20 is clamped to leg 500. This is accomplished by tightening eyebolts 40. The same process is then repeated for each anchor 20 and leg 500 combination.

The preferred embodiments of the invention described herein are exemplary and numerous modifications, dimensional variations, and rearrangements can be readily envisioned to achieve an equivalent result, all of which are intended to be embraced within the scope of the appended claims.

I claim:

1. An anchor attachable to a leg of a canopy framework, said anchor comprising:

a bar having a first end, an opposite second end, and a mid portion therebetween;

said second end having a foot, said foot extending outward from said bar at a substantially right angle;

a weight connected to said bar; and, at least one attaching means for attaching said bar to the leg.

2. An anchor according to claim 1, said at least one attaching means further including:

a first attaching means located near said first end; and, a second attaching means located near said mid portion.

3. An anchor according to claim 2, wherein said weight is located substantially between said first attaching means and said second attaching means.

4. An anchor according to claim 2, wherein said second attaching means is located at least substantially six inches from said second end.

5. An anchor according to claim 2, said first and second attaching means each further including:

a right angle-shaped holder sized to receive the leg, said holder protruding from said bar;

said bar having a thruhole;

a threaded socket connected to said bar and centered over said thruhole; and, a bolt threadably engaging said threaded socket, so that when said bolt is turned said bolt urges the leg into pressurized contact with said holder, thereby clamping said anchor to the leg.

6. An anchor according to claim 5, further including the leg having a cross sectional shape, the cross sectional shape being one of square and circular.

7. An anchor according to claim 1, said at least one attaching means closely contoured to the leg.

8. An anchor according to claim 1, further including:

a first attaching means located near said first end;

a second attaching means located near said mid portion;

said weight located substantially between said first attaching means and said second attaching means;

said first and second attaching means each further including:

a right angle-shaped holder sized to receive the leg, said holder protruding from said bar;

said bar having a thruhole;

a threaded socket connected to said bar and centered over said thruhole;

a bolt threadably engaging said threaded socket, so that when said bolt is turned said bolt urges the leg into pressurized contact with said holder, thereby clamping said anchor to the leg; and, said at least one attaching means closely contoured to the leg.

9. A method for anchoring a canopy framework having a plurality of legs, comprising the steps of:

providing a plurality of anchors, each anchor comprising a bar, a foot, a weight, and at least one attaching means;

transporting one said anchor to the proximity of a leg;

orienting said anchor so that said foot is pointed down;

positioning said anchor so that said attaching means receives a leg;

engaging said attaching means so that said anchor is clamped to the leg; and, repeating said abovestated steps with additional said anchors for other legs.

10. The method according to claim 9, wherein said step of transporting includes carrying said anchor by said foot.

11. An anchor attachable to a leg of a canopy framework, said anchor comprising:

a bar having a first end and an opposite second end;

said second end having a foot, said foot extending outward from said bar at a substantially right angle;

a weight having a first end and an opposite second end, said second end of said weight connected to said first end of said bar; and, at least one attaching means for attaching said weight to the leg.

12. An anchor according to claim 11, said at least one attaching means further including:

a first attaching means located near said first end of said weight; and, a second attaching means located near said second end of said weight.

13. An anchor according to claim 12, wherein said second attaching means is located at least substantially six inches from said second end of said bar.

14. An anchor according to claim 12, said first and second attaching means each further including:

a right angle-shaped holder sized to receive the leg, said holder protruding from said weight;

said bar having a thruhole;

a threaded socket connected to said bar and centered over said thruhole; and, a bolt threadably engaging said threaded socket, so that when said bolt is turned said bolt urges the leg into pressurized contact with said holder, thereby clamping said anchor to the leg.

15. An anchor according to claim 14, further including the leg having a cross sectional shape, the cross sectional shape being one of square and circular.

16. An anchor according to claim 11, said at least one attaching means closely contoured to the leg.

17. An anchor according to claim 11, further including:

a first attaching means located near said first end of said weight;

a second attaching means located near said second end of said weight;

said first and second attaching means each further including:

a right angle-shaped holder sized to receive the leg, said holder protruding from said weight;

said bar having a thruhole;

a threaded socket connected to said bar and centered over said thruhole;

a bolt threadably engaging said threaded socket, so that when said bolt is turned said bolt urges the leg into pressurized contact with said holder, thereby clamping said anchor to the leg; and, said at least one attaching means closely contoured to the leg.

* * * * *